US005638889A

United States Patent [19]

Sugiura et al.

[11] Patent Number: 5,638,889

[45] Date of Patent: Jun. 17, 1997

[54] SEMI-MOLTEN METAL MOLDING APPARATUS

[75] Inventors: Yasuo Sugiura; Hiroshi Seo; Seiji Saikawa, all of Shizuoka, Japan

[73] Assignee: Asahi Tec Corportion, Shizuoka, Japan

[21] Appl. No.: 637,031

[22] Filed: Apr. 24, 1996

Related U.S. Application Data

[63] Continuation of Ser. No. 194,305, Feb. 3, 1994, Pat. No. 5,575,325.

[30] Foreign Application Priority Data

| | | | |
|---|---|---|---|
| Mar. 14, 1992 | [JP] | Japan | 4-89365 |
| May 20, 1992 | [JP] | Japan | 4-152837 |
| Feb. 3, 1993 | [JP] | Japan | 5-39541 |
| Mar. 10, 1993 | [JP] | Japan | 5-76177 |
| Oct. 22, 1993 | [JP] | Japan | 5-287399 |

[51] Int. Cl.[6] ..... B22D 17/12; B22D 17/04

[52] U.S. Cl. ..... 164/319; 164/312; 164/900; 164/320

[58] Field of Search ..... 164/120, 319, 164/312, 320, 113, 900

[56] References Cited

U.S. PATENT DOCUMENTS

| | | | |
|---|---|---|---|
| 4,512,383 | 4/1985 | Suzuki et al. | 164/13 |
| 4,687,042 | 8/1987 | Young | 164/900 |
| 4,771,818 | 9/1988 | Kenney | 164/113 |
| 4,842,038 | 6/1989 | Fujino et al. | 164/312 |

FOREIGN PATENT DOCUMENTS

| | | | |
|---|---|---|---|
| 55-19499 | 2/1980 | Japan . | |
| 57-11760 | 1/1982 | Japan | 164/312 |
| 58-05748 | 2/1983 | Japan . | |
| 59-24567 | 2/1984 | Japan | 164/312 |
| 60-152358 | 8/1985 | Japan . | |
| 63-108957 | 5/1988 | Japan | 164/312 |
| 1-178359 | 7/1989 | Japan | 164/312 |

*Primary Examiner*—Joseph J. Hail, III
*Assistant Examiner*—I.-H. Lin
*Attorney, Agent, or Firm*—Sughrue, Mion, Zinn, Macpeak & Seas

[57] ABSTRACT

The present invention is to provide a semi-molten metal molding apparatus with a die including a die hole and a cavity, and a punch movable into the die hole, in which the die hole is opened downwardly, and the punch is set below the die hole in such a manner that it is movable into the die hole. According to the present invention, the cavity is filled with a part of the material which has no oxide film or has an oxide film smaller in thickness.

17 Claims, 13 Drawing Sheets

SEMI-MOLTEN METAL MOLDING APPARATUS

This is a continuation of application Ser. No. 08/194,305, filed Feb. 3, 1994 and now issued as U.S. Pat. No. 5,575,325.

BACKGROUND OF THE INVENTION

The present invention relates to a molding apparatus of the type that a thixotropic alloy material is heated substantially semi-molten, and filled in the cavity of a mold, to form a desired product, and more particularly to a molding apparatus which is so designed that an oxide formed on the surface of the material is prevented from mixing in the molding, and to an improvement of a molding material supplying device in the apparatus.

In addition, the present invention relates to a manufacturing method which is suitable for producing wheels of light alloy for automobiles or motor-bicycles, and an apparatus for practicing the method, and more particularly to a method of heating the thixotropic alloy material.

Recently, light alloys such as aluminum alloys and magnesium alloys have been extensively employed as materials for forming mechanical products such as automobile components and office equipment. The light alloys are, in general, formed by die casting or other casting methods.

In a conventional casting method, a metal material is heated higher than the liquidus so that the molten material is poured into the mold. Hence, when the molten material is cooled in the mold, dendrites grow in the material, thus lowering the mechanical strength of the molding or causing defects therein. If, in the casting method, a molding material liable to explode at temperatures near the liquidus is employed, then it must be molten in an inactive atmosphere. As a result, an apparatus for practicing the method and accordingly its operation are unavoidably intricate.

With a conventional semi-molten metal molding apparatus, a molding is formed as follows: That is, as shown in FIG. 6, a metal billet B which has been semi-molten by heating, is pressed against a die D by a punch P, so as to flow through a runner R into a metal mold M to fill the cavity C with the metal billet B, to form a molded article into a desired shape.

In the molding operation, the billet B is heated at high temperature to be semi-molten as described above. Hence, while being moved from a heating device (not shown) to the mold, the billet contacts the air, so that a thick oxide film S is formed on the surface of the billet. When the billet B is pushed out of the die D with the punch P, the oxide film S is caused to flow together with the billet body to the cavity C, where it is mixed in the molding. The oxide film thus mixed lowers the mechanical strength or quality of the molding depending on its nature.

The above-described difficulties may be eliminated by employing the following method: The heating of the billet, and the movement of the billet thus heated to the die D are carried out in an inactive atmosphere so that it may not contact the air. However, if an inactive atmosphere is provided at all the places where the billet is heated and moved as described above, then it will make the apparatus bulky and expensive, and increase the manufacturing cost of the molding.

One of the difficulties involved in the practicing of the above-described method is that, after being heated semi-molten at high temperature, the light metal must be quickly molded with its temperature maintained unchanged. That is, if the temperature of the material is excessively high during molding, then primary crystals formed in the material are coarse, so that the resultant product is low in mechanical characteristic, or the liquid phase fraction is high, so that it is not suitably semi-molten, and furthermore the material at high temperature is greatly oxidized to form an oxide film on the surface thereof, which is liable to mix in the molding. If, on the other hand, the temperature of the material is excessively low, then it is impossible for the punch to apply a sufficiently high pressure to the material, so that the resultant molding may be incomplete.

The above-described method of molding a semi-molten light alloy into a wheel for automobiles or motor-bicycles, and the apparatus for practicing the method are well known in the art (see, for example, Examined Japanese Patent Application Publication No. 5748/1983 or Unexamined Japanese Patent Application (OPI) No. 19499/1980).

However, there are some problems to be solved in the method, and it is not practically in use yet. One of the reasons for this fact is that the material is not high enough in yield. Roughly stated, there are two reasons for this poor yield. One of the reasons resides in defects which are formed during molding; that is, impurities are mixed in the molding or shrinkage cavities are formed therein. The surface of the material flowing in the cavity of the mold is covered with a relatively thick oxide film. Hence, when the flow of material branches in the cavity, or the flows of material meet together, the oxide film is mixed inside the material. The other reason is that the gate member is large. The gate is extended outwardly from the cavity, and in order to facilitate the cutting of the gate member, a small diameter portion is necessary to be formed at the portion where it is connected to the cavity. Thus, the gate is relatively long.

One example of the method of heating the material is a so-called "rheocasting method" in which, in order to eliminate casting defects or difficulties accompanying production technique, a metal material is made molten and then cooled until it shows solid and liquid phases, and under this condition the metal material is sufficiently stirred by a mechanical method or electromagnetic induction method, to stop the growth of dendrites, or to finely break them, and the material is casted after such a process is performed (see, for example, Unexamined Japanese Patent Application (OPI) No. 152358/1985). On the other hand, in the case of using a metal material such as a magnesium alloy which is oxidized substantially at the melting temperature, the employment of the rheocasting method is not practical, being applicable only to a magnesium foundry, causing other methods to be employed. That is, a so-called "thixoforging method" is employed in which a billet casted by rheocasting is heated again until it shows both solid and liquid phases, and the billet thus processed is pressed and filled in the mold.

As described above, the thixoforging method uses the billet formed according to the rheocasting method. Hence, the thixoforging method is advantageous in that a forging, excellent in quality, can be formed without using a high temperature oven for melting a material; however, it is disadvantageous in that it needs a large number of manufacturing steps when counted from the billet casting step, which increases the manufacturing cost of the product.

SUMMARY OF THE INVENTION

In view of the foregoing, an object of the present invention is to substantially prevent the oxide film formed on the billet from moving into the cavity of the mold.

Intensive research has been done on the prevention of the mixing of oxides, to find that the oxide film formed on the metal material is larger in thickness towards the bottom. That is, the oxide film formed on an outer surface of the billet moves downwardly by its own weight, and then another oxide film is newly formed on the upper portion of the billet, and moved downwardly. Thus, on the outer surface of the billet, the resultant oxide film is larger in thickness towards the bottom of the billet.

The foregoing object and other objects of the present invention have been achieved by the provision of the following aspects:

The first aspect of the present invention is to provide a semi-molten metal molding apparatus with a die including a die hole and a cavity, and a punch movable into the die hole, in which, according to the first aspect, the die hole is opened downwardly, and the punch is set below the die hole, in such a manner that it is movable into the die hole.

The die hole is opened downwardly, and the punch is lifted into the die hole. Hence, the cavity is filled with a part of the material which has no oxide film or has an oxide film smaller in thickness.

In the second aspect of the present invention, the molding material is heated in the path of the punch, or it is heated while being kept over the punch.

The material is heated in the path of the punch. Hence, when the material is heated to a predetermined temperature, it can be quickly inserted from the path of the punch into the die, where it is pressurized.

The third aspect of the present invention is to provide a semi-molten metal molding apparatus with a molding device including a die and a punch; a conveying device for supplying a billet to the molding device; and a heating device for heating the billet on the conveying device, in which the conveying device includes a pushing disk and a turning disk.

In the fourth aspect of the present invention, a molding material is led to the center of the part of the cavity which corresponds to the hub of a wheel to be molded, to fill the cavity therewith. Furthermore, according to the fourth aspect, the direction of opening and closing of the mold is coincided with the direction of axis of the wheel formed in the cavity, and a material passageway is opened in the part of the cavity which corresponds to the hub of the wheel. Moreover, the apparatus includes a cutting step: That is, a shearing member is provided in such a manner that it is confronted with the cavity and is movable towards the material passageway, and after the cavity is filled with the material, a part of the wheel formed in the cavity is cut off to separate the wheel from the gate material remaining in the material passageway. In addition, the direction of opening and closing of the mold is coincided with the direction of axis of the wheel in the cavity, and the material passageway through which an extruding device is coupled to the cavity, and the shearing member which is movable towards the material passageway are in alignment with the direction of axis of the wheel in the cavity.

The semi-molten material extruded from the pressurizing chamber by the extruding device is caused to flow through the material passageway into the part of the cavity which corresponds to the hub of the wheel, and then flow radially outwardly through the parts of the cavity which correspond to the spokes of the wheel, towards the part of the cavity which corresponds to the rim of the wheel, to fill it. When the material is suitably solidified, the shearing member provided on the other side of the cavity is pushed into the material passageway while cutting a part of the wheel, as a result of which the wheel is separated from the gate material. The material passageway and the shearing member are in alignment with the axis of the wheel in the cavity. Hence, with the mold opened, the portion of the molding from which the gate material is removed by cutting can be utilized for forming a hole for the shaft of the wheel, which facilitates the machining of the wheel.

The fifth aspect of the present invention is to improve the conventional thixoforging method thereby to provide a forging method which is able to form a product quickly without melting the material which is equivalent in quality to the product formed by the thixoforging method. That is, in the thixoforging method in which an alloy, the solute component of which is within the limit of solid solubility, is employed as a molding material, and the molding material is heated until it shows solid and liquid phases, the molding material thus heated is pressurized with a die and a punch, so that it is caused to flow in the cavity, to form a molding; the molding material is quickly heated from ordinary temperature to a temperature near the liquidus, and then gradually heated over the liquidus until it is softened. Thereafter, a pressure molding step is effected.

The solute components of alloys used are each within the limit of solid solubility; that is, alloys except those which have each a solidus and a liquidus and contain a solute component in eutectic rate, have the region between the liquidus and the solidus in which the material has solid and liquid phases. An alloy containing a solute component within the limit of solid solubility is heated relatively quickly with high energy efficiency, and when the temperature of the material substantially reaches the solidus, the heating speed is decreased. This process eliminates the non-uniformity in temperature distribution which is due to the quick heating and the mass effect; that is, the resultant material is uniform in temperature as a whole, thus having a liquid phase. Thereafter, being heated slowly, the material is uniformly raised in temperature, and the liquid phase fraction is increased, while the difficulty is eliminated that the material is partially overheated to locally grow dendrites.

The nature, utility and principle of the present invention will be more clearly understood from the following detailed description and the appended claims when read in conjunction with the accompanying drawings.

BRIEF DESCRIPTION OF THE DRAWINGS

In the accompanying drawings:

FIG. 8(*b*) is a sectional view taken along line III—III in FIG. 8(*a*);

FIGS. 8(*c*) and 8(*d*) are sectional views taken along line IV—IV in FIG. 8(*b*);

FIG. 13(*b*) is a phase-equilibrium diagram of the Al-Si alloy employed in the present embodiments;

FIG. 13(*c*) is a diagram enlarging a part of FIG. 13(*a*) in addition to liquid phase rates.

DETAILED DESCRIPTION OF THE PREFERRED EMBODIMENTS

Preferred embodiments of the present invention will be described with reference to the accompanying drawings.

First Embodiment

Figure 1:
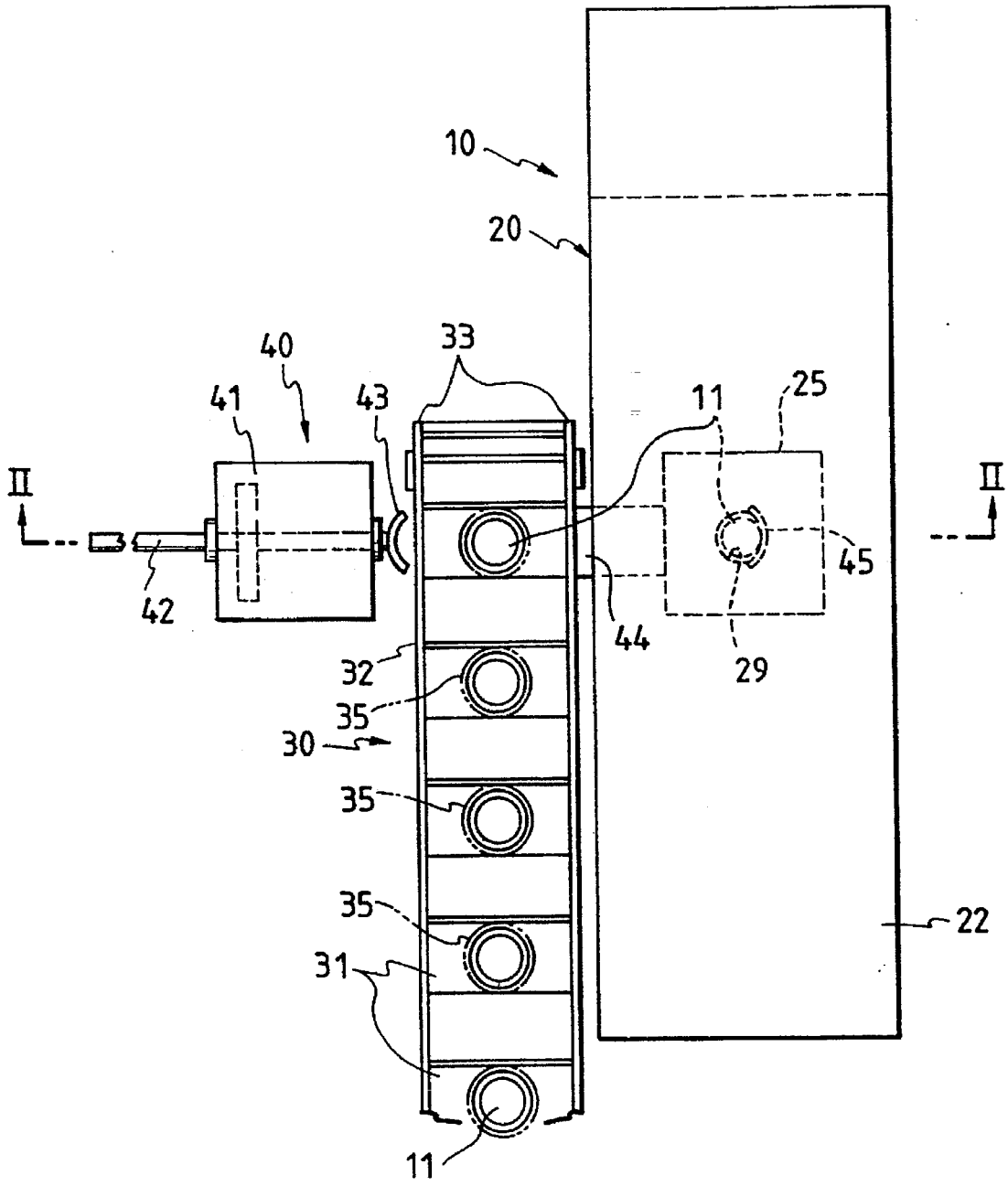
FIG. 1 is a plan view showing a part of a semi-molten metal molding apparatus, which constitutes a first embodiment of the present invention.

FIG. 1 shows a semi-molten metal molding apparatus 10, which constitutes a first embodiment of the present invention. The semi-molten metal molding apparatus 10 is provided with a molding machine 20 including a press, a conveyor 30 for supplying billets 11 to the molding machine 20, and a billet shifting device 40 for shifting the billet 11 from the conveyor 30 to the molding machine 20.

Figure 2:
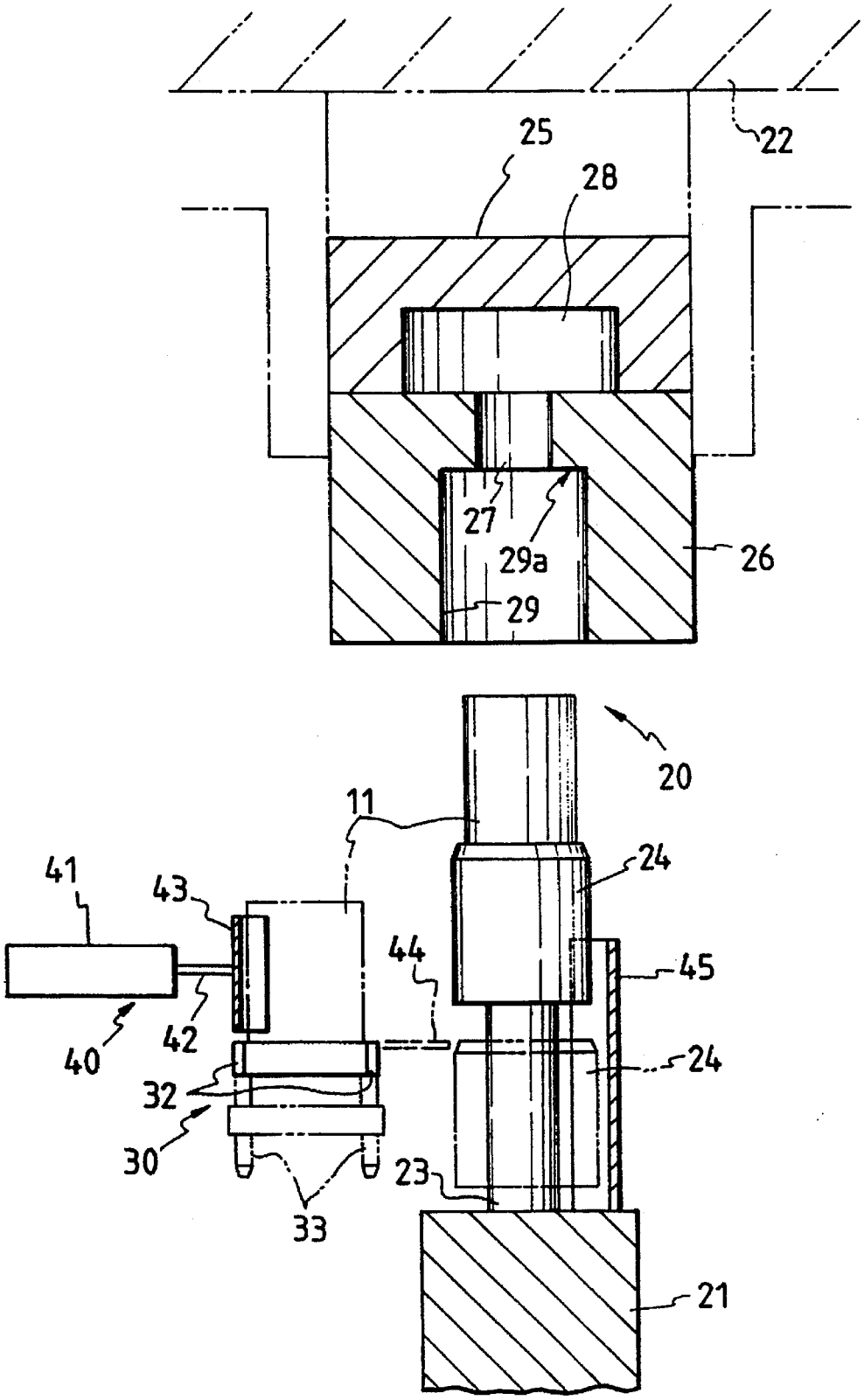
FIG. 2 is a sectional view taken along line II—II in FIG. 1.
Figure 3:
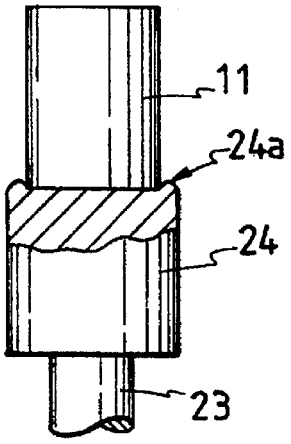
FIG. 3 is a sectional view showing a locational construction between a punch, a ram and a billet in the present invention.

The molding machine 20, as shown in FIG. 2, includes: a bed 21, and an upper frame 22 which is supported above the bed 21 like a gate. A ram 23 is provided on the bed 21, and is moved vertically by a hydraulic cylinder (not shown). A punch 24 is integrally mounted on the ram 23. The upper peripheral portion of the punch 24, as shown in FIG. 3, is formed into an annular wall which is protruded upwardly. In the embodiment, the annular wall is triangular in section; however, it is not limited thereto or thereby. For instance, the annular wall 24*a* may be trapezoid or square in section.

Referring back to FIG. 2, a mold 25, which is a metal mold, and a die 26 integral with the mold 25 are suspended from the upper frame 22. The die 26 is in the form of a cylinder made of a hardened die steel. More specifically, the die 26 has a die hole 29 having a vertical axis, and a runner 27, in such a manner that the die hole 29 and the runner 27 are coaxial. The runner 27 is slightly smaller in diameter than the die hole 29, and is communicated with the cavity 28 formed in the mold 25.

The runner 27 is formed in the flat wall of the die 26 at the center, which is the bottom of the die hole 29 and located in the direction of movement of the punch 24. The flat wall defining the runner 27 is annular, and serves as a supporting surface 29*a* for supporting the upper end of the billet 11 inserted into the die hole 29. In the embodiment, the mold 25 is vertically separable from the die 26. That is, by moving the mold 25 upwardly or by retracting the die 26 downwardly, the cavity 28 is opened, to take the molding out of the mold.

The conveyor 30 has a number of plate-shaped stands 31 (hereinafter referred to as "plate stands 31", when applicable) on which the billets 11 are to be set. Those plate stands 31 are coupled to one another, like a caterpillar, with chains and link members 32 arranged on both sides of them, and are driven through sprockets 33. In the embodiment, the sprockets 33 are intermittently driven by an inverter-controlled electric motor; more specifically, they are stopped whenever the plate stands 31 are each moved as much as the distance between adjacent plate stands 31; that is, as much as the pitch of arrangement of those plates stands (hereinafter, positions where the plate stands 31 stop is referred to as "stations", if applicable). After the plate stands are held stopped for a predetermined period of time, they are driven again to move by the pitch. Thus, the billets 11 on the plate stands 31 are intermittently conveyed. Although FIG. 2 illustrates the conveyor 30 traveling in a perpendicular direction with respect to the axis of the punch 24, the conveyor 30 could also travel in a direction which is skewed with respect to the axis of the punch 24.

In view of the consumption of energy and the formation of oxide film, it is preferable to heat the billet 11 immediately before it is pushed into the mold 25. However, in the case where the billet 11 is large in thermal capacity, it is not suitable to heat it at one time, because the heating takes a relatively long period of time, thus decreasing the productivity. That is, it is preferable that the billet 11 is preheated once or twice before finally heated near the mold 25.

A plurality of high-frequency heating coils 35 are provided above the conveyor 30; more specifically, they are positioned at the stations of the conveyor 30 except the last station, respectively. The high-frequency heating coils 35 are supported by a lift frame (not shown), in such a manner that they are lifted with the lift frame, or reciprocated along the conveyor 30 by the pitch of arrangement of the plate stands 31. As the lift frame moves down, the high frequency heating coils 35 are moved until they surround the billets 11, respectively, and energized to subject the billets to high frequency induction heating. Thus, each of the billets 11 is heated at every station. Hence, when the billet 11 reaches the last station, it has been semi-molten, or substantially semi-molten being preheated at high temperature.

The billet 11 is a solid cylinder of aluminum alloy, about 76 mm in diameter. A robot (not shown) operates to set each billet 11 whose axis is upright on the conveyor 30. Each billet 11 is heated by the heating coils 35 while being conveyed by the conveyor 30. When the billet 11 reaches the last station of the conveyor, its surface temperature has been raised to 300° to 600° C. Thereafter, the billet 11 thus heated is shifted to the molding machine 20.

The conveyor 30 is constructed as described above. Hence, when the plate stands 31, on which the billet 11 have been set, are each moved one pitch and stopped, the high frequency heating coils 35 are moved downwardly to heat the billets 11 on the plate stands 31. As the plate stands 31 are moved, the heating coils 35 are also moved together with the plate stands 31 to continue the heating operation. When the plate stand 31 is moved to the next station and stopped there, the high frequency heating coil 35 is lifted and returned to the original position, where it is later moved downwardly to heat another billet 11 located below it, after the plate stands have been moved again. The high frequency heating coils 35 cooperate with the conveyor 30 to heat the billets 11. In the above-described manner, the billets 11 on the plate stands 31 are moved intermittently station to station. Thus, finally when one of the billets 11 reaches the end of the conveyor 30, and its plate stand 31 is stopped, a material supplying device, namely, the billet shifting device 40 operates to shift the billet 11 from the plate stand 31 onto the upper surface of the punch 24.

The billet shifting device 40 includes: an air cylinder 41, and a pushing member 43 coupled to the end of the piston rod 42 of the air cylinder 41. The pushing member 43 is formed by curving a steel plate along the outer cylindrical surface of the billet 11. As the piston rod 42 is reciprocated, the pushing member 43 is reciprocated. More specifically, when the piston rod 42 is retracted, the pushing member 43 is set back to the predetermined position before the conveyor 30; and when the piston rod 42 is maximumly protruded, the pushing member 43 is moved across the conveyor 30 to the bed 21 of the molding machine 20. In FIGS. 1 and 2, reference numeral 44 designates a bridging member through which the plate stand 31 is coupled to the upper surface of the punch 24; and 45, a stopper for preventing the billet 11 from moving over the punch 24 when pushed by the pushing member 43.

In the embodiment designed as described above, the billet 11, which is a metal material, is semi-molten or nearly semi-molten at high temperature while being conveyed by the conveyor 30. When the billet 11 comes to the end of the conveyor 30, it is shifted from the plate stand 31 onto the punch 24 by the billet shifting device 40; that is, it is placed on the punch 24.

Figure 4:
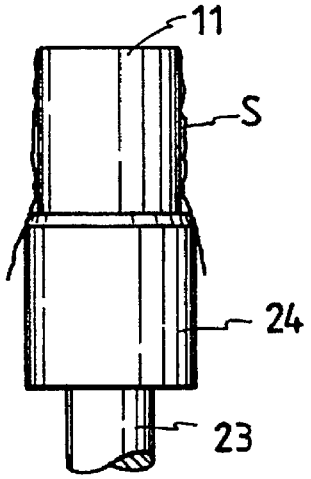
FIG. 4 is a sectional view showing a thick oxide film formed on an outer surface of the billet in the present invention.

The billet 11 on the conveyor 30 is heated to high temperature by the high frequency heating coil 35 while touching the air until it is shifted onto the punch 24. As a result, a thick oxide film S is formed on the outer surface of the billet 11 as shown in FIG. 4. The oxide film S tends to slide down by its own weight or when shocked or vibrated while the billet is being conveyed by the conveyor 30 or lifted into the die hole 29 by the punch 24. Since, the oxide film S is supported by the inner surface of the annular wall 24*a;* the annular wall 24*a* prevents the oxide film S from further sliding down.

During the above mentioned period, the punch 24 is being lifted. Finally, the punch 24 pushes the billet 11 into the die hole 29 formed in the die 26, and firmly pushes it against the supporting surface 29*a* corresponding to the upper end of the die hole 29. In this operation, the billet 11 is pushed by the punch 24 from below with its upper end held against the supporting surface 29*a*. As a result, the billet 11 is decreased in length, while increased in diameter, so that the oxide film S is not moved as the billet is being firmly pushed against the inner surface of the die 26. Hence, as shown in FIGS. 5(*a*) to 5(*d*), the oxide film S is partially broken as it confronts the runner 27, so that the material B1 of the billet which is not oxidized is allowed to flow through the runner 27 into the cavity 28. The molten material in the metal mold, being cooled, is solidified into a molding. Thereafter, the metal mold 25 is split, to take the molding out of it. The molding thus formed is of improved quality, including no oxide film.

The molding operation described with reference to FIGS. 5(*a*) to 5(*d*) is described later in more detail.

Second Embodiment

Figure 7:
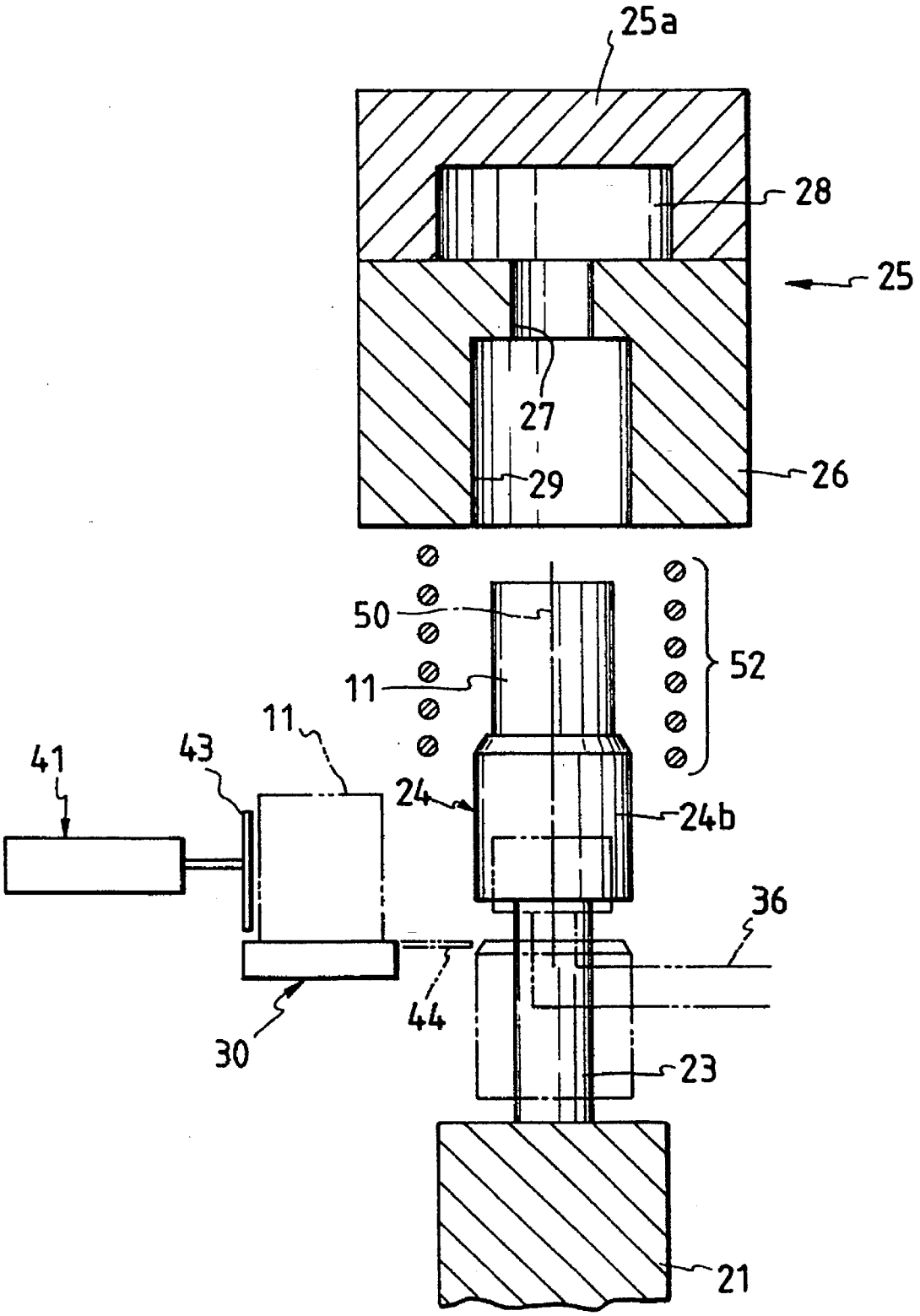
FIG. 7 is a sectional view, corresponding to FIG. 2, showing a semi-molten metal molding apparatus, which constitutes a second embodiment of the present invention.
Figure 8A:
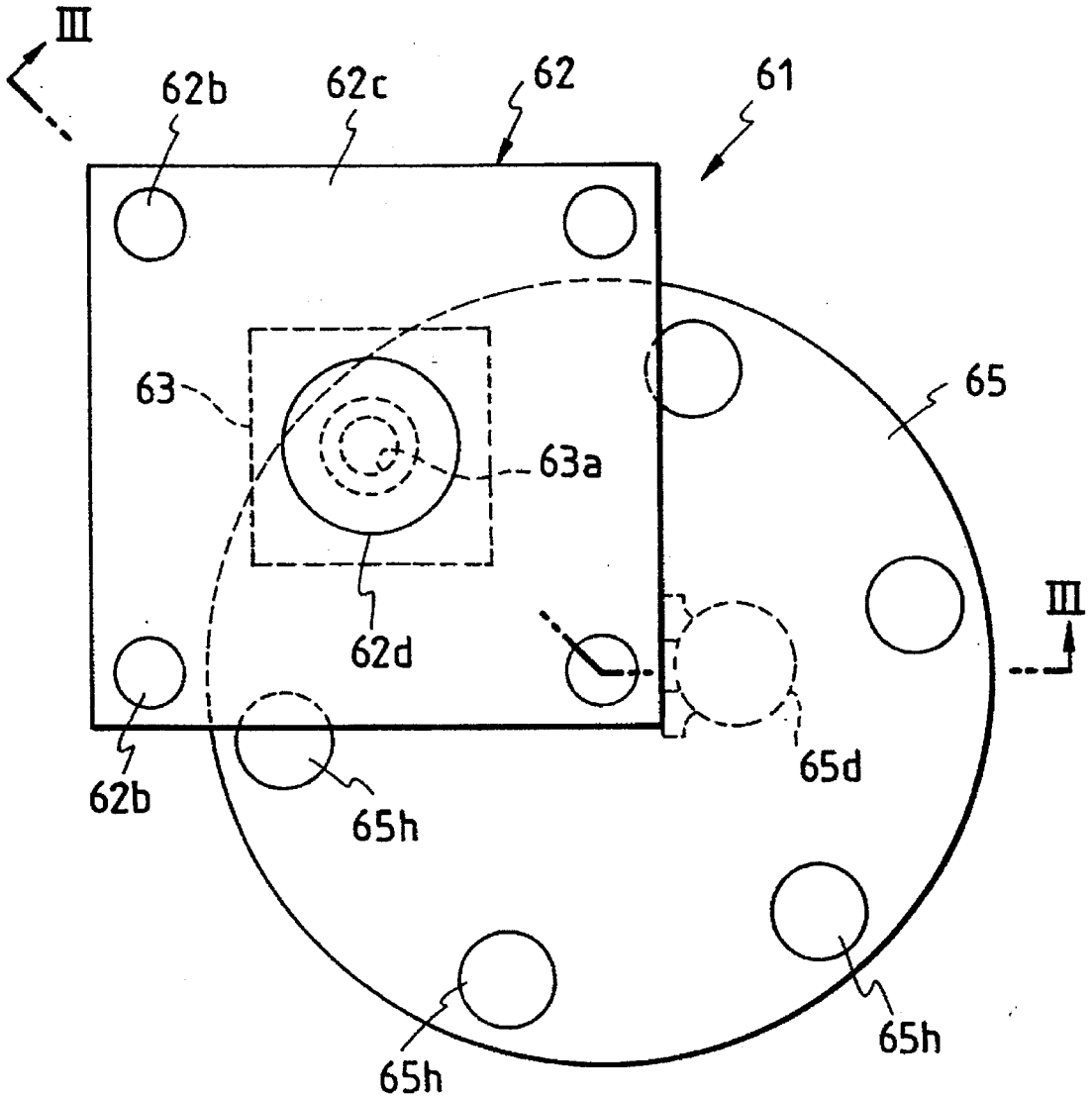
FIG. 8(*a*) is a plan view showing essential components of a semi-molten metal molding apparatus, which constitutes a third embodiment of the present invention.
Figure 8B:
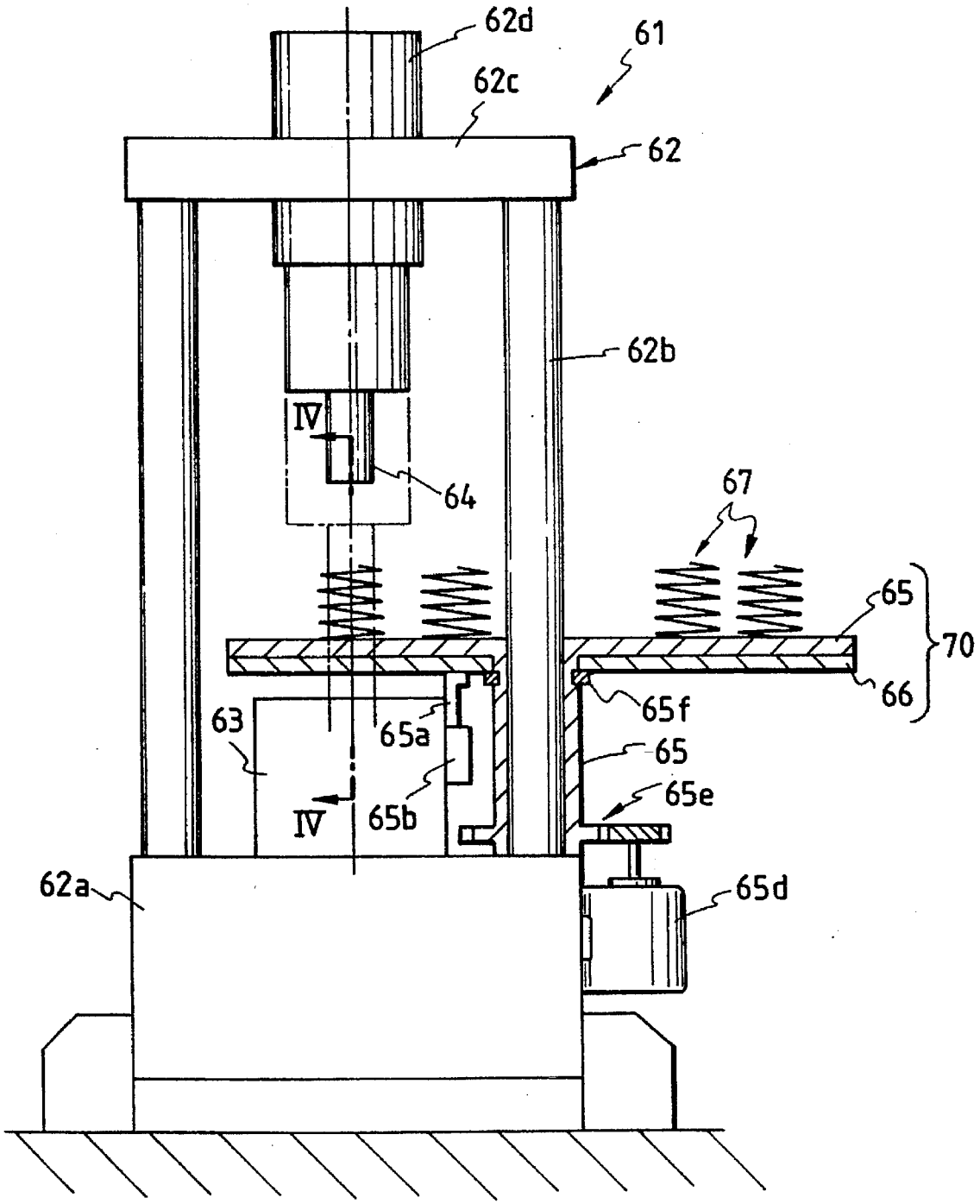
Figure 8D:
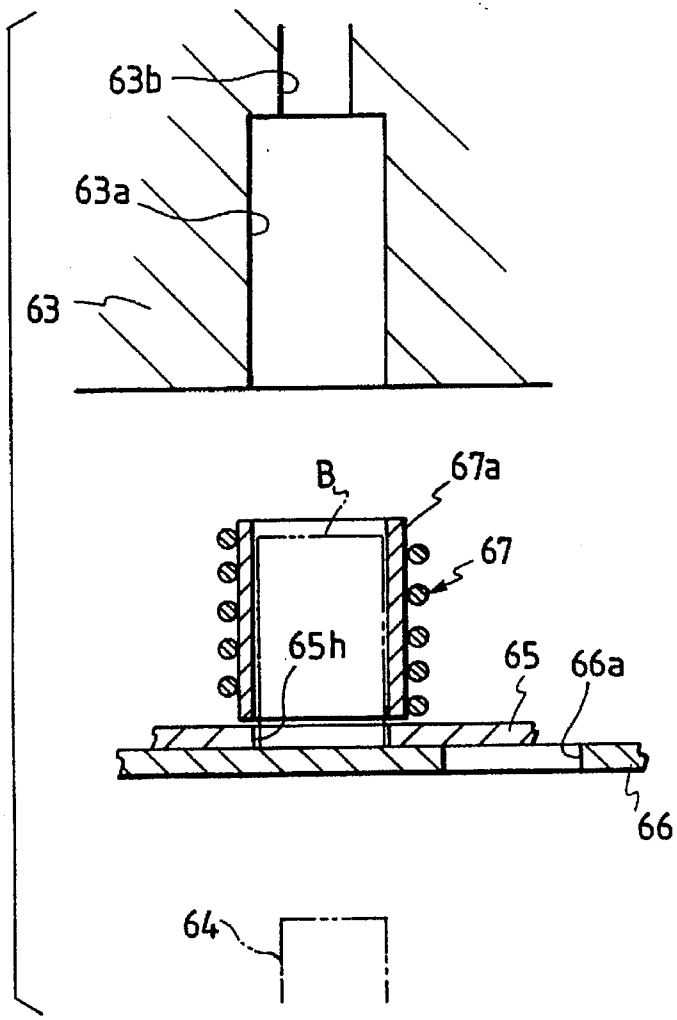
Figure 8C:
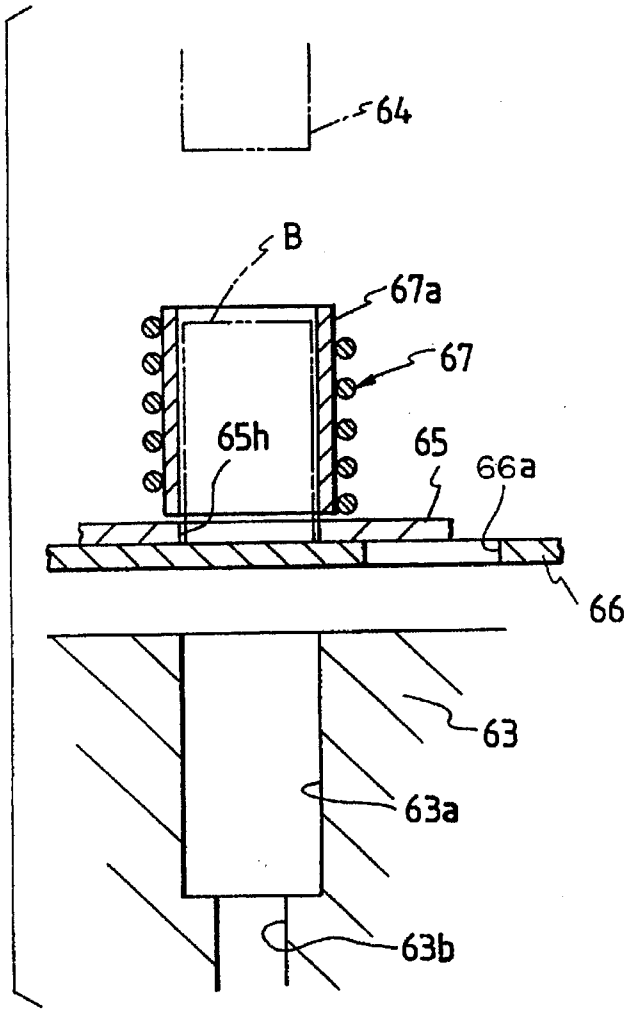
Figure 9A:
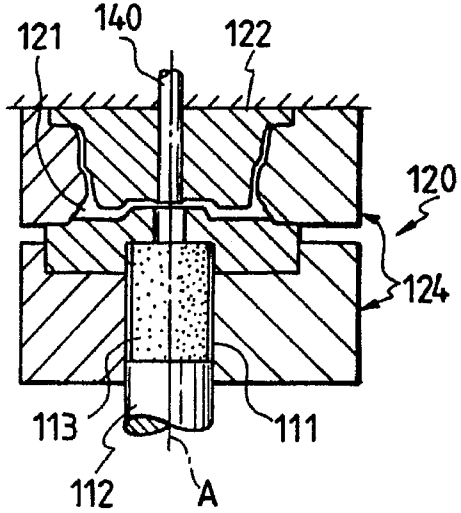
FIGS. 9(*a*) to 9(*d*) are diagrams showing a series of steps of forming a wheel according to a fourth embodiment of the present invention.
Figure 9B:
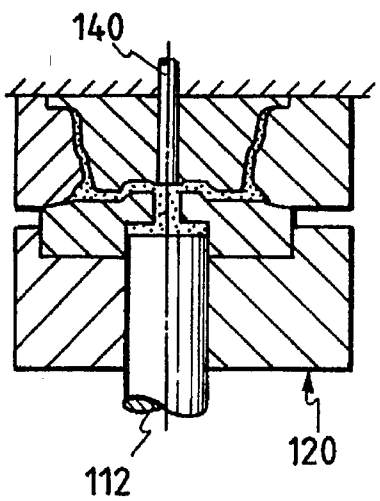
Figure 9C:
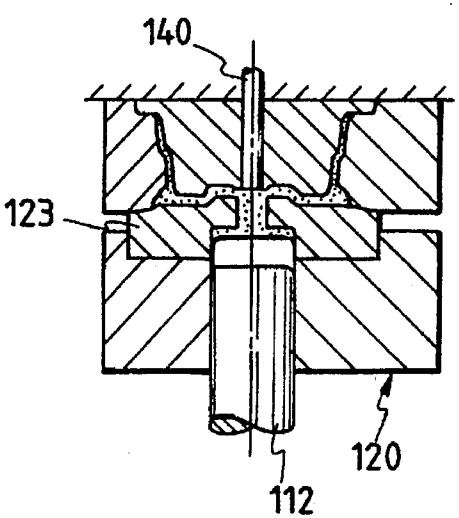
Figure 9D:
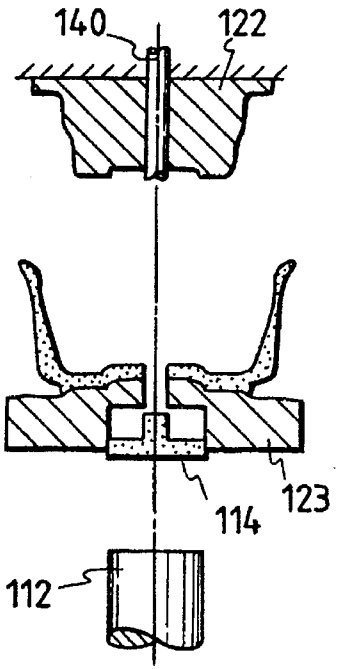

A second embodiment of the present invention is described with reference to FIG. 7, in which parts corresponding functionally to those in the above-described first embodiment are designated by the same reference numerals or characters.

A molding machine 20 is made up of a hydraulic press. In the molding machine, a metal mold 25 is set above a bed 21. A punch 24 is provided on the bed 21 in such a manner that it is vertically movable. A heating device, namely, a high frequency heating coil 52 is provided between the metal mold 25 and the punch 24, to heat a billet 11 until it is semi-molten. In the second embodiment, the path 50 along which the punch 24 is moved is straight; that is, the punch 24 is moved in a straight manner; however, the present invention is not limited thereto or thereby.

The punch 24 includes: a hydraulic force cylinder (not shown) supported on the bed 21; a ram 23 inserted into the cylinder; and a punch head 24*b* threadably engaged with the upper end portion of the ram 23. The billet 11 is set on the punch head 24*b*. The billet 11 thus set is lifted into the heating coil 52, where it is held until it is sufficiently heated. The punch head 24*b* is frequently set near the heating coil 52, and therefore it is liable to be consumed by heat. In order to replace the punch head 24*b* with ease, it is threadably engaged with the upper end portion of the ram 23.

In the second embodiment, the punch 24 is used not only as a device for pushing the billet 11 in the die 26, but also as a holding device for holding the billet 11 at the heating position and a shifting device for shifting the heated billet 11 into the die 26. The holding device may be provided separately from the punch 24. That is, as shown in FIG. 7, a robot handle 36 is provided, which operates as follows: The robot handle 36 grips the billet 11 pushed in by a pushing member 43, and lifts it, and holds it until it is sufficiently heated by the heating coil 52. Thereafter, the punch head 24*b* is moved upwardly to receive the billet 11. When the billet 11 is set on the punch head 24*b,* the robot handle 36 releases the billet 11, and the punch 24 is further moved upwardly to push the billet 11 in the die 26.

The metal mold 25 includes: a mold body 25*a* having a cavity 28; and the die 26 which is separably combined with the mold body 25*a*. The die 26 has a die hole 29 as a material inserting hole which is opened downwardly. A runner 27 is formed in the flat wall of the die 26, which corresponds to the bottom of the die hole 29. Hence, the die hole 29 is communicated through the runner 27 directly with the cavity 28 of the mold body 25*a*.

The operation of the second embodiment thus organized is described.

First, the billet 11 is conveyed to a predetermined position by a conveyor 30. When, under this condition, a plate stand 31 stops immediately before an air cylinder 41, the pushing member 43 is moved forwardly, to shift the billet 11 from the plate stand 31 through a bridging member 44 onto the punch 24, the upper surface of which has been made flush with the plate stand 31.

When the billet 11 is set on the punch 24, the punch 24 is moved upwardly until the billet 11 is set inside the heating coil 52. Under this condition, high frequency current is supplied to the heating coil 52 for a predetermined period of time, as a result of which the billet 11 is heated to a high temperature, around 570° C. After the predetermined period of time has passed, the punch 24 is further moved upwardly to move the billet 11 into the die 26, and to push the billet 11 against the die 26 to push it into the runner 27.

In the second embodiment, in heating the billet 11, the heating period of time is detected, to indirectly detect the temperature of the billet 11; however, the temperature of the billet 11 may be directly detected. Furthermore, in the second embodiment, the high frequency heating device is employed; however, the present invention is not limited thereto or thereby. For instance, in the case of a billet relatively large in diameter, about 127 mm, middle frequency heating may be employed. In addition, induction heating may be employed to heat the billet 11. In the above-described embodiment, the billet 11 is heated outside the die 26; however, the embodiment may be so modified that the heating device such as the heating coil 52 is provided inside the die 26, so as to heat the billet 11 inside the die 26.

The billet 11, being pressurized by the punch 24, is caused to deform like fluid, and then to flow into the cavity 28 through the runner 27, so that the cavity 28 is filled with the billet 11. When the molding finishes, the mold body 25*a* and the die 26 are separated vertically from each other, to open the cavity 28 to take the molded article out of it.

As described above, in the first and second embodiments of the present invention, the semi-molten billet is placed on the punch, and then, under this condition, the billet is lifted into the die. Therefore, the thick oxide film falling in the semi-molten billet can be prevented from mixing into the molded article.

Furthermore, the billet 11 is preheated several times while the billet 11 is conveyed by the conveyor 30 and the billet 11 is set on the punch head 24*b*. Therefore, the billet 11 can be quickly and smoothly moved into the die 26. As a result, the billet is scarcely decreased in temperature while being conveyed, and the material heating temperature can be reduced, whereby the amount of oxide formed on the billet is decreased, and the quantity of oxide mixing in the molding is decreased as much. That is, a molding excellent in quality can be formed with a semi-molten metal material according to the present invention.

Third Embodiment

The molding apparatus of this type must be considerably high in rigidity, somewhat bulky, because great forces act on it as a whole. With the apparatus, the material conveying distance is long. On the other hand, an industrial robot has an arm which can be bent or stretched. It is quite dangerous for a person to enter the range of movement of the robot's arm.

Therefore, below is described an embodiment for supplying the billet to the molding machine without using the billet shifting device for shifting the billet from the conveyor to the molding machine, as a third embodiment of the present invention with reference to FIGS. 8(*a*) to 8(*d*). For convenience, description of the third embodiment with reference to FIGS. 8(*a*) to 8(*c*) is indicated with the semi-molten metal molding apparatus of the type shown in FIG. 6.

In FIG. 8(*a*), reference numeral 61 designates a molding apparatus for molding a semi-molten metal material. The molding apparatus 61 includes: a molding device including a die 63 and a punch 64 which are supported by a press machine 62; a conveying device 70 for supplying a molding material, namely, a billet B to the molding device; and a heating device for heating the molding material on the conveying device 70.

The press machine 62, forming an essential part of the molding device, is designed as follows: As shown in FIGS. 8(*a*) and 8(*b*), four rod-shaped supports 62*b* are extended from a bed 62*a* which supports the die 63, and a top plate 62*c* is mounted on the upper ends of the supports 62. A hydraulic cylinder device 62*d* are set on the top plate 62*c* at the center. The aforementioned punch 64 is connected to the lifting ram of the hydraulic cylinder device 62*d*, and it is reciprocated (moved up and down) between the position indicated by the solid line and the position indicated by the phantom line. The die 63, as shown in FIG. 8(*c*), is in alignment with the axis of movement of the punch 64, and has a die hole 63*a* which is slightly larger in diameter than the billet B. A runner 63*b* is formed in the bottom of the die hole 63*a* at the center, which is communicated with the cavity (not shown) of a metal mold. The die hole 63*a* is coaxial with the punch 64. The conveying device 70 supporting the billet B, and the heating device, namely, heating coils 67 for subjecting the billets B to high frequency induction heating are provided between the die hole and the punch.

The conveying device 70 includes a pushing disk 65 and a turning disk 66. The pushing disk 65 is rotatably supported by one of the four supports 62*b*. The turning disk 66 is rotatably supported on the pushing disk 65, and coupled through a rod 65*a* to a hydraulic cylinder 65*b*, so that it is turnable through a small angle. The pushing disk 65 is driven as follows: The pushing disk 65 has a boss at the center, which is rotatably mounted on the aforementioned one of the supports 62*b*. The boss, and accordingly the pushing disk 65 is intermittently driven through a reduction gear train 65*e* by an electric motor 65*d*. The electric motor 65*d* is an induction motor the angle of rotation of which is controlled by an inverter with high precision. The turning disk 66 is rotatably mounted on the boss of the pushing disk 65. The axial movement of the turning disk 66 thus mounted is prevented with a thrust clip 65*f* engaged with the boss. The turning disk has a passage hole 66*a* for the billet B which is opened between the die 63 and the punch 64. When the billet B reaches the upper end of the passage hole, it passes through the passage hole by its own weight, thus dropping into the die hole 63*a*.

The pushing disk 65 has six circular holes 65*h* which are arranged on a circumference at equal angular intervals. Each of the circular holes 65*h*, as shown in FIG. 8(*c*) is slightly larger in diameter than the billet B. Hence, when the billet is inserted into the circular hole 65*h*, it is supported on the turning disk 66 from below. When several billets are inserted in the circular holes 65*h* located before the passage hole 66*a*; that is, they are arranged along an arcuate line, they are forwarded to the molding device (described later). When the pushing disk 65 is turned intermittently in synchronization with the vertical movement of the punch 64; that is, when the pushing disk 65 is turned through a predetermined angle while the punch is lifted, the billet B slides on the turning disk 66; that is, it is moved along the aforementioned arc from one side to the other side. In the turning disk 66, the billet passage hole 66*a* is positioned in the direction of movement of the disk along the aforementioned arcuate line, and is substantially equal in diameter to the circular holes 65*h*. The turning disk 66 is driven by the hydraulic cylinder 65*b*, to selectively take a first position to close the circular holes 65*h* or a second to align the billet passage hole 66*a* with the circular hole 65*h*. When the turning disk 66 takes the second position, the circular hole 65*h* and the passage hole 66*a* which are in alignment with each other are right above the die hole 63*a*, so that the billet B drops from the turning disk 66 through the passage hole 66*a* into the die hole 63*a* by its own weight.

The heating device includes a plurality of heating coils 67 to which high frequency current is applied. Each of the heating coils 67 is provided at one position or at several positions before the billet passage hole 66*a*, to heat the material while the conveyance of the material by the conveying device 70 is suspended. The heating coil 67, as shown in FIG. 8(*c*), is wound on a ceramic bobbin 67*a*. In the embodiment, four heating coils 67 are provided, one at the position where each circular hole 65*h* stops, and three for three circular holes 65*h* located before that position. In association with the vertical movement of the punch 64, the heating coil is vertically moved by a lifting device (not shown) with a predetermined period. At least when the heating coil 67 is moved upwardly, the billet B is caused to pass below it, and the following step is effected. Before the punch 64 is moved downwardly, the heating coil 67 is moved downwardly, and at the same time high frequency current is applied to the heating coil, so that the temperature of the billet B is quickly raised by the Joule heat due to the eddy current.

On the other hand, the billets B are supplied into the six circular holes 65*h* of the pushing disk 65. When one of the billets comes right above the die hole 63*a* as the pushing disk 65 turns, the pushing disk 65 is stopped. Under this condition, the heating coil 67 is moved downwardly, to heat it from outside by high frequency induction heating. The bobbin 67*a* is to protect the coil from external obstructions, and to minimize the contact of the billet with the surrounding air during the heating, to thereby impede it's oxidation. An inert gas may be supplied such as carbon dioxide or nitrogen gas into the bobbin.

When the billet B set right above the die hole 63*a* is heated to semi-molten, the respective heating coil 67 is deenergized (the remaining heating coils being kept energized). Under this condition, the turning disk 66 is turned by the hydraulic cylinder 65*b* until the billet passage hole 66*a* is aligned with the circular hole 65*h*, so that the billet B thus heated drops into the die hole 63*a*. Immediately after this, the punch 64 is moved downwardly by the hydraulic cylinder device 62*d*, thus entering the die hole 63 through the heating coil 67. The punch thus moved pressurizes the billet B which has been set in the die hole 63*a*, to cause the billet to flow through the runner 63*b* into the metal mold to form a molding.

After the molding has been formed, the next billet is heated. For this purpose, as the punch 64 is moved upwardly, all the heating coils are also moved upwardly, and the turning disk 66 is returned to the original position, and the pushing disk 65 is turned to move and set the next billet B right above the die hole 63*a*.

Figure 6:
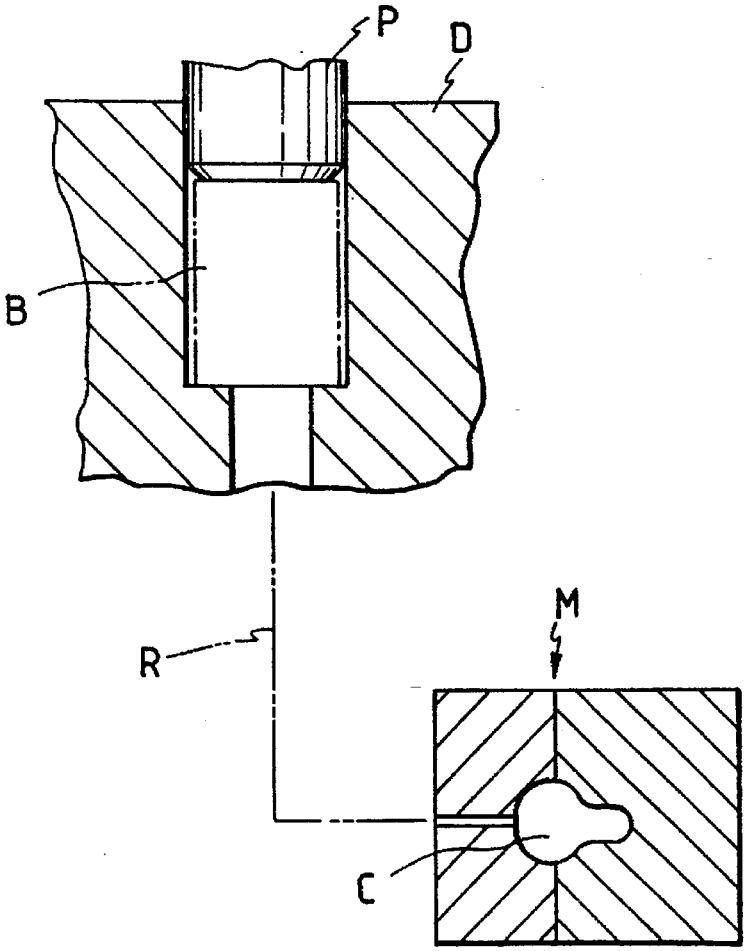
FIG. 6 PRIOR ART
FIG. 6 is a sectional view, corresponding to FIG. 2, showing a conventional semi-molten metal molding apparatus.
Figure 5A:
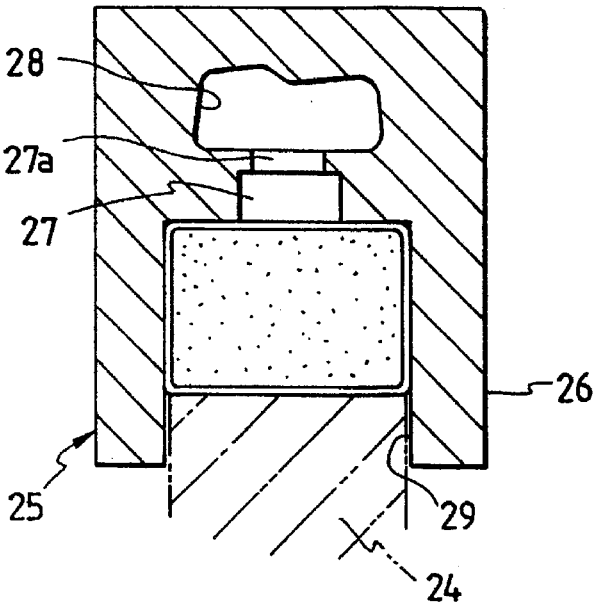
FIGS. 5(*a*) to 5(*d*) are sectional views, corresponding to FIG. 2, for a description of the general behavior of a semi-molten material.
Figure 5B:
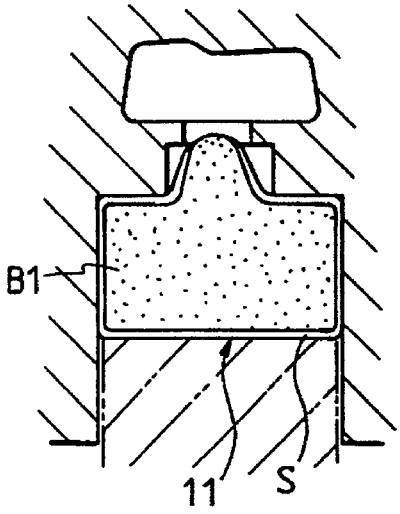
Figure 5C:
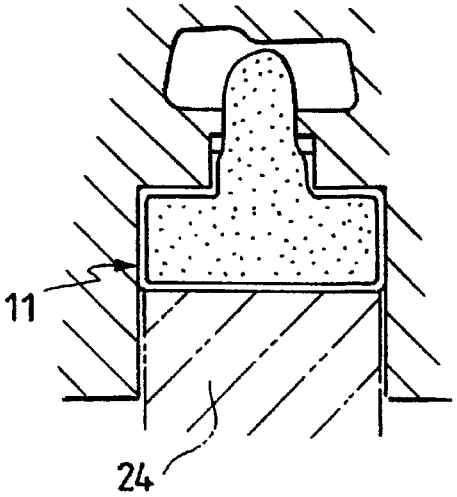
Figure 5D:
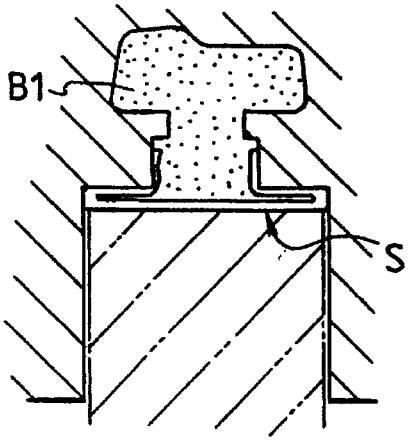

Although FIGS. 8(*a*) to 8(*c*) are shown with the semi-molten metal molding apparatus of the type shown in FIG. 6, the third embodiment without using the billet shifting device can be modified into the construction of the first and second embodiments. FIG. 8(*d*) shows the locational relationship between the die 63, heating coils 67, billet B, pushing disk 65, turning disk 66, and punch 64.

In the third embodiment modified slightly as shown in FIG. 8(*d*), the billets B are supplied into the six circular holes 65*h* of the pushing disk 65. The heating coils 67 are provided at the positions of the circular holes 65*h*. When one of the billets comes right above the punch 64 as the pushing disk 65 turns, the pushing disk 65 is stopped. Under this condition, the heating coil 67 positioned above the punch 64 is moved downwardly, to heat the billet from the outside by high frequency induction heating. When the billet B set right above the punch 64 is heated semi-molten, the respective heating coil 67 is deenergized (the remaining heating coils being kept energized). Under this condition, the turning disk 66 is turned by the hydraulic cylinder 65*b* until the billet passage hole 66*a* is aligned with the circular hole 65*h*, so that the billet B thus heated drops on the punch 64. Immediately after this, the punch 64 is moved upwardly by the hydraulic cylinder device 62*d* disposed bellow the conveying device 70, thus entering the die hole 63 through the heating coil 67. The punch thus moved pressurizes the billet B which has been set in the die hole 63*a*, to cause the billet to flow through the runner 63*b* into the metal mold to form a molding. After the molding has been formed, the next billet is heated. For this purpose, as the punch 64 is moved downwardly, all the heating coils are also moved upwardly, and the turning disk 66 is returned to the original position, and the pushing disk 65 is turned to move and set the next billet B right above the punch 64.

As described above, in the third embodiment, the material conveying distance is desirably short, so that the installation of the machine requires a considerably small area; that is, the space in the factory is economically used.

Fourth Embodiment

A fourth embodiment of the present invention is described with reference to FIGS. 9(*a*) through 11. In the fourth embodiment for producing wheels of light alloy for automobiles or motor-bicycles, since a conveyor and a billet shifting device have the same functions as that of the first to third embodiments, descriptions of these components are omitted.

Figure 10:
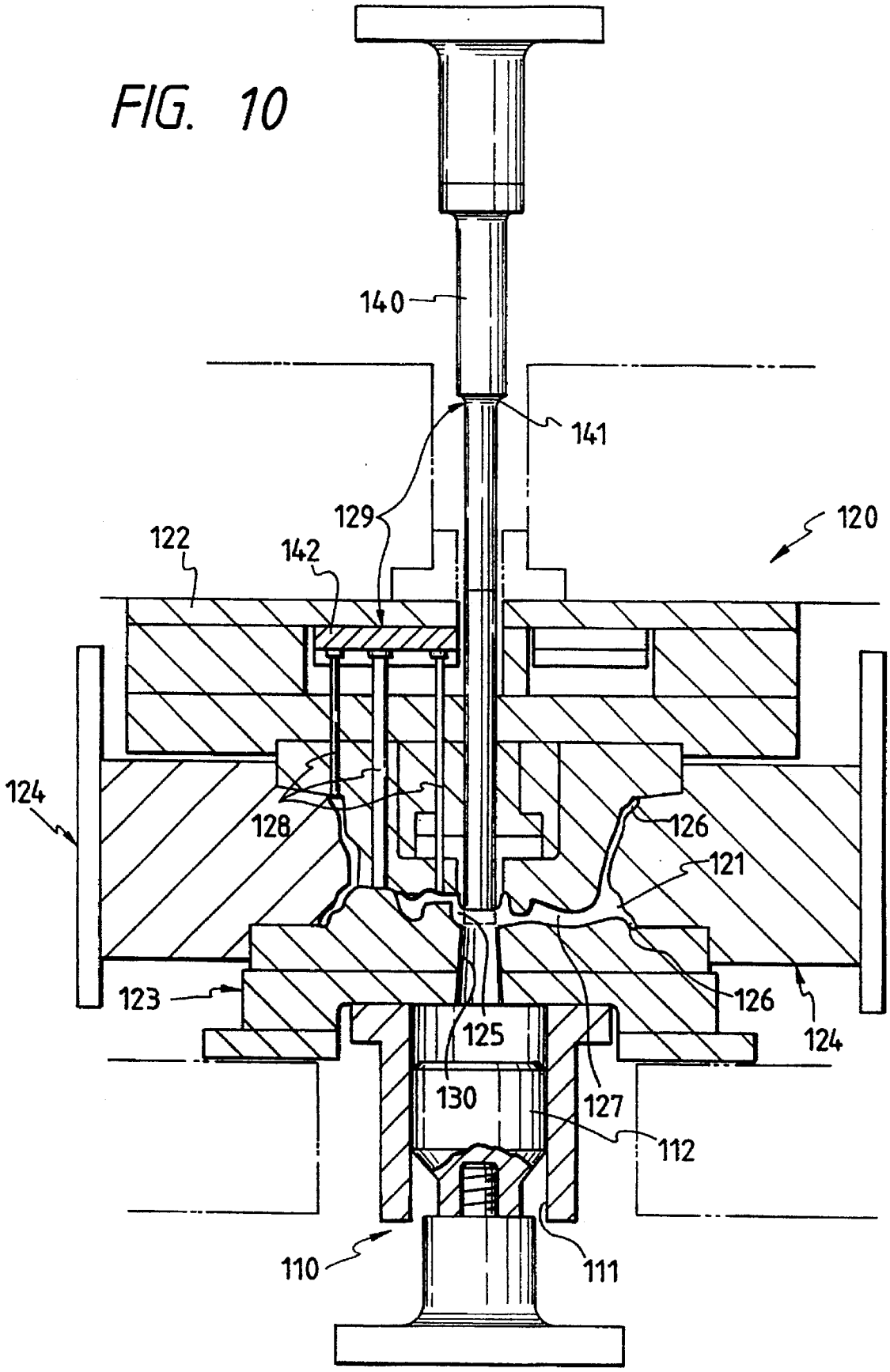
FIG. 10 is a sectional view showing a metal mold employed in the fourth embodiment of the present invention.

As shown in FIG. 10, a pressing device 110 is provided with a pressurizing chamber 111 having an annular shape, and a punch 112 moving vertically along the pressurizing chamber 111. A mold 120 is made up of upper and lower molds, namely, a stationary mold 122 and a movable mold 123, and a pair of side molds 124 and 124, with a cavity 121 therebetween. In the embodiment, the cavity 121 is to form a motor vehicle's wheel W; that is, it has parts for forming the hub 125 and the rim 126 of the wheel W and the spokes joining between them. The punch 112, and a material passageway 130, and a shearing member 140 (described later) are arranged on the axis A of the wheel W. In other words, the cavity 121 is so formed that the mold opening and closing direction is coincident with the direction of axis of the wheel, and the opening of the material passageway 130 to the cavity 121 is confronted with the aforementioned shearing member 140 on the axis A of the wheel W.

The shearing member 140 is designed as follows: As was described before, it is extended through the stationary mold 122 adapted to form the hub 125 of the wheel W. In addition, it is driven by a reciprocating mechanism, to go through the cavity into the material passageway 130. In FIG. 10, reference numeral 128 designates extruding pins for separate the molding (wheel) from the mold; and 129, an operating mechanism for driving the extruding pins 128. The operating mechanism 129 includes: a step 141 formed on the shearing member 140; and an extrusion plate 142. The operating mechanism 129 operates as follows: While the shearing member 140 is being raised into the material passageway 130, the step 141 pushes the extruding plate 142 downwardly, so that a number of extruding pins 128 on the extruding plate 142 are pushed from the stationary mold 122 into the cavity 121, thereby to remove the molding, the wheel W of light alloy, from the stationary mold 122. In this case, the extrusion of the molding with the extruding pins 128, and the cutting of the gate can be achieved at the same time, because, as was described before, the mold opening and closing direction is coincided with the direction of movement of the shearing member 140.

Figure 11A:
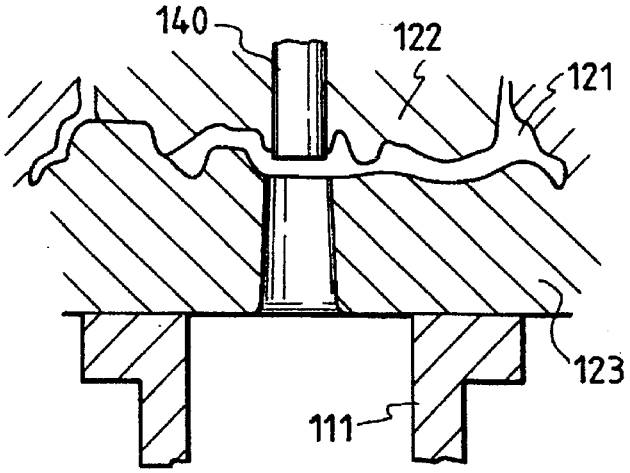
FIGS. 11(*a*) to 11(*c*) are sectional views for a detailed description of the wheel forming steps shown in FIG. 9.
Figure 11B:
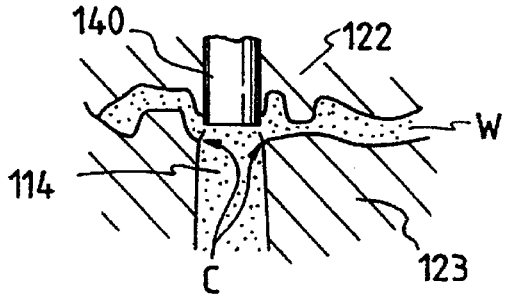
Figure 11C:
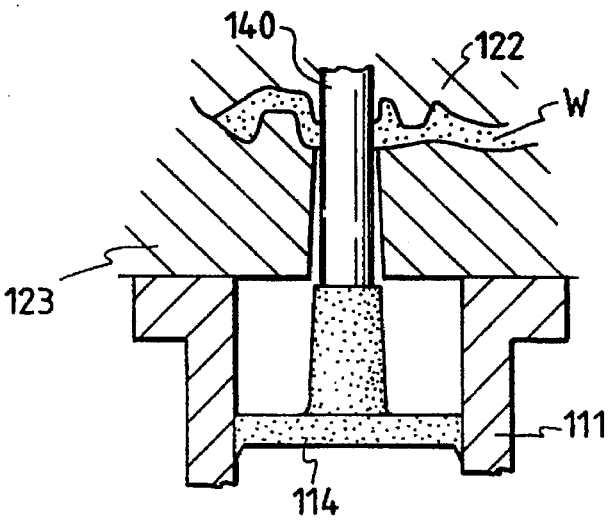

The operation of the molding apparatus according to the present invention is described with reference to FIGS. 9 and 11. FIG. 9(*a*), and FIG. 11(*a*) show the initial step of the operation. In the initial step, the mold 120 has been closed, and a material 113 which has been substantially semi-molten is supplied into the pressurizing chamber 111. In FIG. 9(*b*), a punch 112 is moved upwardly to cause the material 113 to flow, under pressure, from the pressurizing chamber 111 through the material passageway 130 into the cavity 121 to fill the cavity 121.

In this operation, the material 113 flows, in the form of a bar, through the material passageway 130 into the cavity 121, to strike the upper mold, namely, the stationary mold 122, so that it is flattened, thus becoming disk-shaped. Under this condition, the material 113 is continuously supplied through the material passageway, and therefore the disk-shaped material is gradually increased in diameter; that is, the material 113 flows along the parts of the cavity, which correspond to the spokes 127 of the wheel W, while spreading radially outwardly, and finally reaches the part of the cavity which corresponds the rim 126 of the wheel W, where it is stopped. When the material has reached the part of the cavity corresponding to the rim 126, the cavity is completely filled with the material, or the light alloy, and the internal pressure is increased. After the cavity has been filled up with the material, a higher pressure is applied to the material 113 by the punch 112 for two (2) to ten (10) seconds, to increase the density of material in the molding, or the wheel W, thereby to reduce the diameters of small holes formed in the molding, or to eliminate shrinkage cavities therefrom.

FIG. 9(*c*) shows the molding which has been formed, and the punch 112 which is being raised. In this operation, as the punch 112 is lifted, the shearing member 140 is lifted substantially at the same time. Hence, as shown in FIG. 11(*b*), the shearing member 140, cooperating with the opening of the material passageway 130, forms round cracks C in the middle of the hub 125 of the wheel W, so that the wheel W is separated from the material 114 which is solidified at the gate (hereinafter referred to as "a gate material 114", when applicable). The shearing member 140 is further moved through the hub 125 into the material passageway 130 to push the gate material 114 into the pressurizing chamber 111 as shown in FIG. 11(*c*), so that it can be removed therefrom with ease.

When the shearing member 140 is moved into the material passageway 130 in the above-described manner, the movable mold 123 is moved downwardly, to leave the stationary mold 122, thus opening the cavity 121. Immediately after this, the step 141 of the shearing member 140 pushes the extruding plate 142 downwardly. As a result, the extruding pins 128 fitted on a lower surface of the extruding plate 142 are pushed from the stationary mold 122 into the cavity 121, to separate the wheel W of light alloy from the stationary mold 122.

The gate material 114 is removed together with a part of the wheel W which fills a part of the cavity which is separated from the wheel W in the above-described manner; that is, the gate material 114 has not been cut off. Hence, the apparatus of the present invention, unlike the conventional one, is free from the difficulty that the gate material is left on a part of the wheel W, and it must be cut off with a saw. The gate material 114 is coupled to the wheel W on the axis of the wheel W, and therefore the hole which the shearing member 140 forms to remove the gate material 114 can be used as a prepared hole to machine the shaft hole of the wheel W. That is, the drilling step may be simplified, or eliminated, which contributes to simplification of the following machining operation.

FIG. 9(*d*) shows the mold 120 which is opened, and the punch 112 and the movable mold 123 which are moved downwardly together with the gate material 114, and the shearing 140 and the extruding pins 128 which are returned to the original positions. The resultant molding, namely, the wheel W of light alloy are lightly set on the movable mold 123 being separated from the stationary mold 122; that is, it can be removed from the apparatus with the conveying robot (not shown).

As described above, in the molding method of the present invention, the number of times of splitting the flow of molding material, and the number of times of joining the flows of material are minimized. Therefore, the oxide film or impurities on the surfaces of those flows of material will never mixed with the molding, and the resultant product is free from defects such as shrinkage cavities, holes and cracks. In addition, the shearing member 140 separates the gate material 114 together with the hub 125, and therefore no gate material 114 is left on the wheel W at all. This eliminates the step of removing the gate material from the wheel W, and the hole which the shearing member 140 forms to remove the gate material 114 can be used as a prepared hole to machine the shaft hole of the wheel W.

In the molding apparatus according to the present invention, the cavity 121 is divided in the direction of axis of the wheel, and the material passageway 130 is confronted with the shearing member 140 on the axis A. Hence, a device for practicing the above-described method, such as the shearing member 140 and the extruding pins 128 may be arranged inside the part of the cavity which corresponds to the rim of the wheel; that is, no large space is required for the installation of the pins. Thus, the molding according to the present invention is high in yield, and the apparatus can be miniaturized. Hence, the formation of a wheel with a semi-molten light alloy according to the present invention is considerably practical.

Fifth Embodiment

Figure 14:
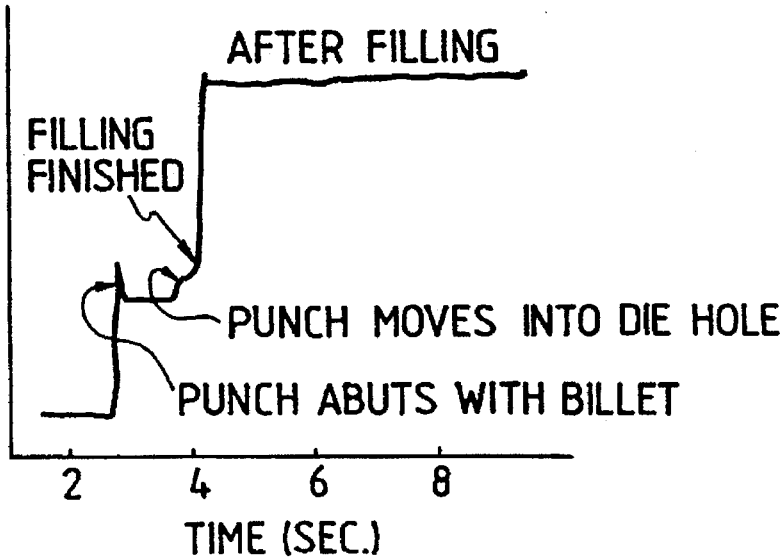
FIG. 14 is a graphical diagram indicating the pressurizing curve of a punch during molding.

Moreover, a method of heating the thixotropic alloy material is described with reference to FIGS. 12, 13 and 14 as a fifth embodiment of the present invention.

In the fifth embodiment, an aluminum alloy containing 11% silicon by weight, and a magnesium alloy containing 8% aluminum by weight and 1% zinc by weight are employed as metal material to be molded. The billet 11 is in the form of a rod 76 mm (3 in.) in diameter, 60 mm in length, and 480 g in weight. FIG. 13(*a*) is an equilibrium diagram of the Mg-Al alloy employed in the embodiment, and FIG. 13(*b*) is also an equilibrium diagram of the Al-Si alloy employed in the embodiment. That is, FIGS. 13(*a*) and 13(*b*) indicate that the two billets 11 contain solutes, namely, silicon and aluminum within the limit of solubility. FIG. 13(*c*) is a diagram obtained by enlarging a part of FIG. 13(*a*), and added with liquid phase rates.

There is described the heating process of the magnesium alloy billet 11.

Figure 12:
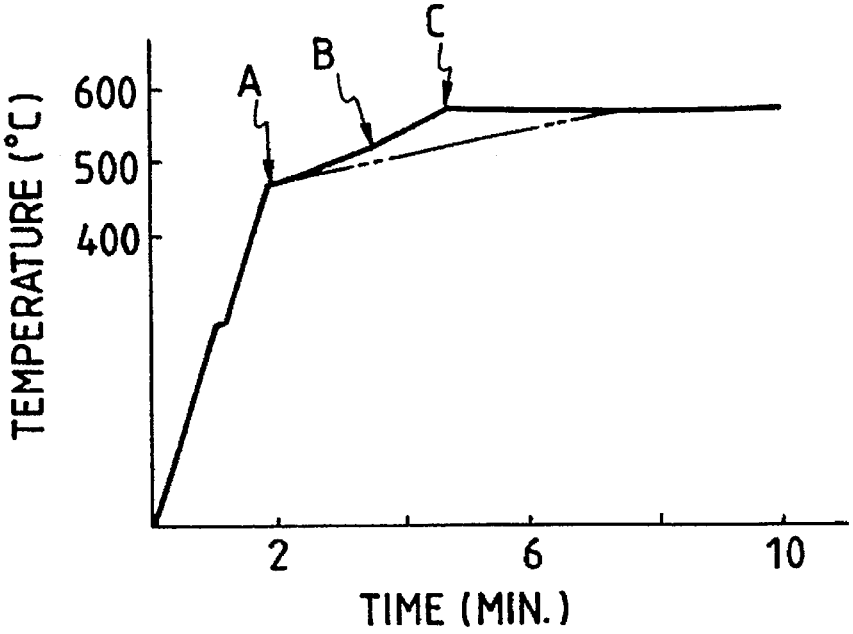
FIG. 12 is a graphical diagram illustrating a molding material heating curve.
Figure 13A:
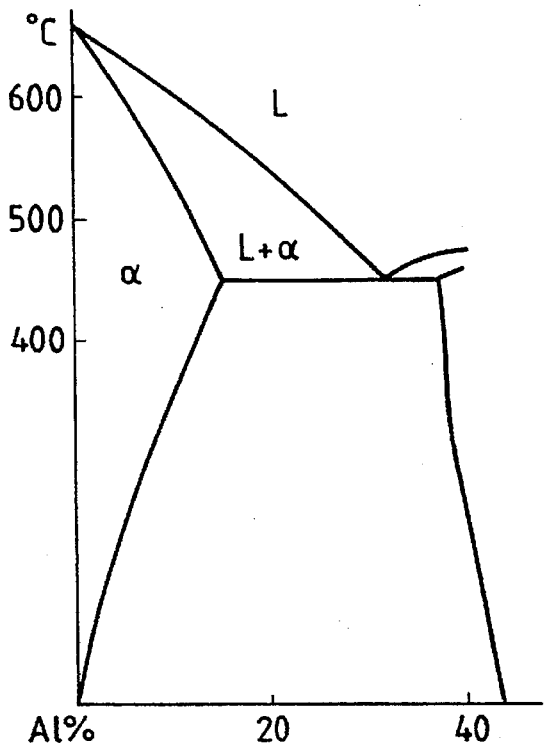
FIG. 13(*a*) is a phase-equilibrium diagram of the Mg-Al alloy employed in the present embodiments.
Figure 13B:
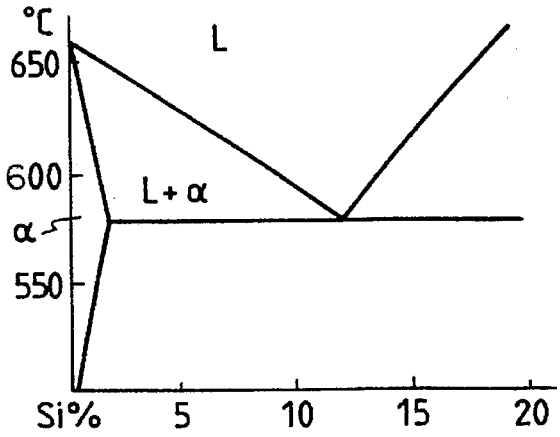
Figure 13C:
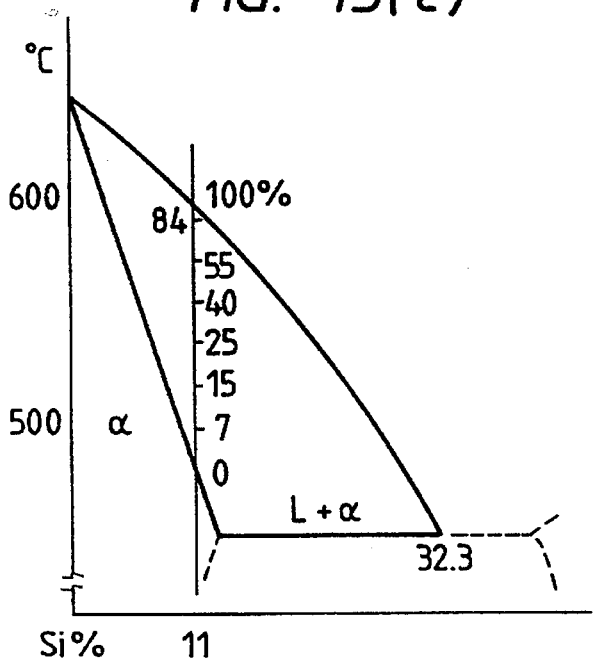

The heating of the billet 11 is carried out, according to the heating curve of FIG. 12, in an inactive atmosphere by high frequency induction heating or low frequency induction heating. That is, it is heated at relatively high speed until its temperature is raised from ordinary temperature to a temperature A (470° C.) corresponding to the solidus, and then heated at relatively slow speed until its temperature reaches a temperature B (560° C.). As a result, the difference in temperature between the inside and the outside of the billet B is zeroed; that is, the billet B is uniform in temperature as a whole, and is held semi-molten, thus being suitable for forging. In the billet at this temperature, the fraction of the liquid phase component is about 46%. Thereafter, the billet is heated at a slightly higher speed to a temperature C (580° C.), and held at the temperature C. In the billet at the temperature C, the fraction of the liquid phase component is increased to 65%. The heating curve passing through the temperatures A, B and C in FIG. 12 may be made dull as indicated by the two-dot chain line.

The heating of the billet to higher than the temperature C is advantageous in that the material flows smoothly during forging; however, it is disadvantageous in that the billet is deformed by its own weight; that is, it becomes difficult to handle it, and dendrites grow. Hence, it is preferable that the billet temperature is in a range of from 570° C. to 580° C. However, even if the billet temperature is in the temperature range, it should be noted that, if the billet is held at the temperature for a long period of time, dendrites grow, and therefore it is necessary to stir it. In this connection, the present inventor has confirmed that if the period of time is within about five (5) minutes, no dendrite grows, and the spherical α phase component is obtained. Hence, it is preferable to hold the billet at a temperature in the above-described temperature range, and to start the following process in a relatively short time.

The heating process of the other billet, namely, the aluminum alloy billet 11 is substantially equal to the above-described heating process of the magnesium alloy billet 11 except that the temperature condition is somewhat different.

The billet 11 heated at the temperature C (580° C.) in the above-described manner is molded with a mold 25 shown in FIGS. 5(*a*) to 5(*d*). The forging mold 1 includes a lower part, namely, a die 3 cooperating with a punch 24, and an upper part, namely, a metal mold having a cavity 28. In the embodiment, the description and illustration of a metal mold parting method are omitted, because it is substantially equal to the method in the first to fourth embodiments.

The die 26 has a circular die hole 29 which is opened downwardly. The die hole 29 is slightly larger in diameter than the above-described billet 11. A runner 27 is formed in the bottom of the die 26, which is communicated with the cavity 28 in the metal mold. A gate 27*a* is formed in the runner 27 in the conventional manner.

The semi-molten billet 11 put in the die hole 29, as shown in FIGS. 5(*a*) to 5(*d*), is deformed by the punch 24, thus filling the cavity 28. In FIG. 4, reference character S designates the oxide film formed on the surface of the billet 11; and B1, the inside of the billet 11 which is not oxidized. FIG. 14 indicates the pressurizing force of the punch 24.

FIG. 5(*a*) shows the punch 24 which has moved into the die hole 29, thus abutting against the billet 11. When, under this condition, the pressurizing force of the punch 24 is increased, as shown in FIG. 5(*b*) the upper surface of the billet 11 swells into the runner 27, as a result of which the oxide film is broken, and the material not oxidized starts to flow. As the punch 24 is further moved, the material not oxidized flows as shown in FIG. 5(*c*), and then fills the cavity 28 as shown in FIG. 5(*c*). The period of time is about two (2) seconds which lapses from the time instant the billet 11 is put in the die hole 29 until the cavity is filled with it.

After the cavity has been filled with the molten billet 11, the punch 24 applies a pressure to the billet 11 in the cavity for about six (6) seconds which is twice as high as the pressure applied thereto at the end of the operation of filling the cavity with the molten billet 11. Thereafter, the mold is opened, to take the molding out of it. Before the billet is put in the mold 25, the mold 25 is preheated at a temperature in a range of 280° C. to 360° C., and an inert gas such as carbon dioxide may be supplied into it. The billet 11 is more or less cooled when passing through the die hole and the runner 27; however, when it is pressured by the punch 24, the resultant deformation resistance increases the temperature of the material. Hence, the material is maintained substantially unchanged in fluidity.

In the embodiment, the aluminum alloy billet and the magnesium alloy billet are employed. However, it goes without saying that the technical concept of the present invention is applicable to the molding of other alloy billets such as for instance an iron alloy billet.

As described above, in the method of the present invention, in heating the forging material until it is semi-molten, the heating speed is so controlled that the forging billet is quickly and uniformly heated as a whole. Hence, the method of the present invention is able to provide semi-molten billet without the melting operation which is required by the conventional rheocasting process. That is, the method of the present invention is able to form an excellent molding with the metal mold which is high in quality as in the conventional thixoforging process, and is moreover low in manufacturing cost.

In the first to fifth embodiments of the present invention as described above, the moving velocity of the punch is not described when the punch is upwardly moved toward the die hole 29 while abutting against the billet. However, the punch is moved at a predetermined velocity so that the billet is not broken down. After the billet is inserted into the die hole, even if the punch is moved at the high velocity, the billet is not broken down owing to an inner surface of the die hole. Therefore, the semi-molten metal molding apparatus of the present invention may have any mechanism to vary the moving velocity of the punch before and after the billet is inserted into the die hole. Further, the upper surface of the punch may be processed with any works so that the billet is not shifted on the upper surface of the punch.

While there has been described in connection with the preferred embodiments of the present invention, it will be obvious to those skilled in the art that various changes and modifications may be made therein without departing from the present invention, and it is aimed, therefore, to cover in the appended claims all such changes and modifications as fall within the true spirit and scope of the present invention.

What is claimed is:

1. A semi-molten metal molding apparatus comprising:

a molding device for forming a molded article, comprising:

a semi-molten metal material comprising a thixotropic alloy, wherein said molded article is formed from said semi-molten metal material;

a die having a cavity and a die hole opened in a downward direction; and a punch having an upper surface arranged below said die hole, wherein said punch is designed to receive said semi-molten metal material on top of said upper surface and is designed to insert said semi-molten metal material into said die hole in an upward direction to fill said cavity with said metal material, and wherein said punch is constructed such that at least a portion of a lateral side of said semi-molten metal material is exposed when said semi-molten metal material is disposed on said upper surface of said punch before said semi-molten metal material is inserted into said die hole.

2. The semi-molten metal molding apparatus of claim 1, wherein said upper surface of said punch includes an annular wall which is formed on an upper peripheral portion thereof and which is protruded upwardly.

3. The semi-molten metal molding apparatus of claim 1, further comprising a first heating device for heating said metal material to a predetermined temperature, wherein said first heating device is located near a path in which said punch moves said metal material to said die hole so that said metal material is heated before said metal material is inserted into said die hole.

4. The semi-molten metal molding apparatus of claim 1, further comprising a conveying device which conveys said metal material to said molding device.

5. The semi-molten metal molding apparatus of claim 4, further comprising a second heating device which heats said metal material to a predetermined temperature when said metal material is on said conveying device.

6. The semi-molten metal molding apparatus of claim 4, wherein said die and said punch are located in a vertical direction and wherein said die and said punch are located in one of a skew direction or a perpendicular direction with regard to a conveying direction of said conveying device.

7. The semi-molten metal molding apparatus of claim 6, further comprising a material shifting device for shifting said metal material from said conveying device to said punch of said molding device.

8. The semi-molten metal molding apparatus of claim 6, wherein said die and said punch are located in said skew direction with regard to said conveying direction of said conveying device.

9. The semi-molten metal molding apparatus of claim 6, wherein said die and said punch are located in said perpendicular direction with regard to said conveying direction of said conveying device.

10. The semi-molten metal molding apparatus of claim 4, wherein said die and said punch are located in a vertical direction and a cross direction with regard to a conveying direction of said conveying device.

11. The semi-molten metal molding apparatus of claim 10, wherein said conveying device includes a pushing disk and a turning disk.

12. The semi-molten metal molding apparatus of claim 1, further comprising:

prevention means for preventing impurities formed on said semi-molten metal material from being injected into said cavity before said metal material is inserted into said cavity in said upward direction.

13. A semi-molten metal molding apparatus for producing a vehicle wheel of light alloy, comprising:

a semi-molten metal material comprising a thixotropic alloy;

a mold including a cavity for forming a wheel having parts of a hub, a rim and spokes joining between said hub and said rim out of said semi-molten metal material, wherein said cavity includes a hub portion having an opening which is opened in a downward direction; and a pressing device for pressing said semi-molten material, wherein said pressing device comprises:

a pressurizing chamber formed into an annular shape for supplying said semi-molten metal material thereinto; and a punch which is vertically moveable along a longitudinal axis of said pressurizing chamber and which has an upper surface, wherein said punch is designed to receive said semi-molten metal material on top of said upper surface and is designed to insert said material placed on said upper surface of said punch into said pressurizing chamber and to force said semi-molten metal material to flow from said pressurizing chamber into said cavity when said punch moves in an upward direction, and wherein said punch is constructed such that at least a portion of a lateral side of said semi-molten material is exposed when said semi-molten metal material is disposed on said upper surface of said punch before said semi-molten metal material is inserted into said pressurizing chamber.

14. The semi-molten metal molding apparatus of claim 13, wherein said mold is made of a stationary mold and a movable mold so as to divide into two pieces.

15. The semi-molten metal molding apparatus of claim 14, wherein a direction of opening and closing of said mold is coincided with a direction of axis of said wheel to be formed in said cavity.

16. The semi-molten metal molding apparatus of claim 13, further comprising a shearing member arranged on an axis of said wheel to be formed and confronted with said cavity, said shearing member being used to separate said wheel from an excess of a molded article.

17. The semi-molten metal molding apparatus of claim 13, further comprising:

prevention means for preventing impurities formed on said semi-molten metal material from being injected into said cavity before said metal material is inserted into said cavity in said upward direction.

* * * * *